US012790101B2

(12) United States Patent
Allen et al.

(10) Patent No.: US 12,790,101 B2
(45) Date of Patent: Nov. 10, 2026

(54) PACKAGE

(71) Applicant: BRITISH AMERICAN TOBACCO (INVESTMENTS) LIMITED, London (GB)

(72) Inventors: Thomas Allen, London (GB); Katalin Sebesteny-Gyore, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 0 days.

(21) Appl. No.: 18/730,147

(22) PCT Filed: Jan. 23, 2023

(86) PCT No.: PCT/GB2023/050143
§ 371 (c)(1),
(2) Date: Jul. 18, 2024

(87) PCT Pub. No.: WO2023/139391
PCT Pub. Date: Jul. 27, 2023

(65) Prior Publication Data

US 2025/0100784 A1 Mar. 27, 2025

(30) Foreign Application Priority Data

Jan. 21, 2022 (GB) ..... 2200804

(51) Int. Cl.
*B65D 85/10* (2006.01)
*B65D 65/42* (2006.01)
*B65D 65/46* (2006.01)

(52) U.S. Cl.
CPC ..... *B65D 85/1027* (2013.01); *B65D 65/42* (2013.01); *B65D 65/466* (2013.01); *B65D 2565/385* (2013.01)

(58) Field of Classification Search
CPC ..... B65B 19/20; B65B 19/22; B65D 85/1045; B65D 85/1056; B65D 85/10568;
(Continued)

(56) References Cited

U.S. PATENT DOCUMENTS 5,333,729 A 8/1994 Wolfe
2013/0319886 A1 12/2013 Ledermann
(Continued)

FOREIGN PATENT DOCUMENTS

CN 112455766 A 3/2021
EP 2138411 A1 12/2009
(Continued)

OTHER PUBLICATIONS

PCT International Search Report and Written Opinion in International Appln. No. PCT/GB2023/050143, dated Jun. 15, 2023, 18 pages.
(Continued)

*Primary Examiner* — King M Chu
(74) *Attorney, Agent, or Firm* — MERCHANT & GOULD P.C.

(57) ABSTRACT

A package for a delivery system includes a container having a wrapper configured to surround at least one delivery system, and a resealable label. The wrapper is sealed by the closure of its openings and an outer surface of the wrapper forms an outer surface of the package. The package includes an inner frame located inside the container. The wrapper includes a first layer having a paper based material, and an extraction region in the wrapper. The label is configured to cover the extraction region and includes a peripheral portion that extends beyond the extraction region such that the extraction region of the wrapper is sealed. The label is peelable away from the wrapper in use to open the extraction region to provide access to the inside of the wrapper.

20 Claims, 8 Drawing Sheets

(58) Field of Classification Search
CPC ..... B65D 85/1027; B65D 85/1018; B65D 85/1081; B65D 85/1036; B65D 85/10; B65D 85/10564; B65D 75/5838; B65D 2575/586; B65D 77/02; B65D 2230/12; B65D 65/40; B65D 17/34; B65D 2401/05
USPC ..... 229/160.1, 87.13, 125.125; 206/245, 206/273, 268, 271, 264
See application file for complete search history.

(56) References Cited

U.S. PATENT DOCUMENTS

| | | | | |
|---|---|---|---|---|
| 2017/0327303 | A1* | 11/2017 | Krasiev | B65D 5/48 |
| 2018/0370716 | A1* | 12/2018 | Draghetti | B65D 85/1056 |
| 2019/0152686 | A1* | 5/2019 | Chatelain | B65D 85/10568 |

FOREIGN PATENT DOCUMENTS

| | | | |
|---|---|---|---|
| EP | 2759491 | B1 | 11/2016 |
| JP | 2010510140 | | 4/2010 |
| WO | 9849072 | A1 | 11/1998 |
| WO | 02066341 | A1 | 8/2002 |
| WO | 2008062159 | A1 | 5/2008 |

OTHER PUBLICATIONS

Japanese Notice of Reasons for Rejection for Application No. 2024542956, dated Nov. 18, 2025, 6 pages (3 pages English Translation, 3 pages Official).
Office Action received for Japanese Patent Application No. 2024-542956, mailed on May 26, 2026, 13 pages (6 pages of English Translation and 7 pages of Official Copy).

* cited by examiner

PACKAGE

RELATED APPLICATIONS

The present application is a National Phase entry of PCT Application No. PCT/GB2023/050143 filed Jan. 23, 2023, which claims priority to GB Application No. 2200804.9 filed Jan. 21, 2022, each of which is hereby incorporated by reference in their entirety.

TECHNICAL FIELD OF THE INVENTION

The present invention relates to a package for delivery systems.

BACKGROUND OF THE INVENTION

Delivery systems, such as cigarettes, are sold in packs. Known packs often comprise an outer carton made from cardboard which has a base and a hinged lid. The base contains a bundle of delivery systems. The delivery systems are wrapped in a flexible barrier layer made of metallized plastic or of a plastic/metal foil laminate.

Such known packs comprise an outer plastic wrapper configured to keep the delivery systems in the package fresh. The outer plastic wrapper is torn open to access the outer carton and disposed of.

SUMMARY OF THE INVENTION

In one aspect of the present invention, there is provided a package for a delivery system. The package comprises a container comprising a wrapper configured to surround at least one delivery system, and a resealable label; wherein the wrapper is sealed by the closure of its openings and an outer surface of the wrapper forms an outer surface of the package; and an inner frame located inside the container; wherein the wrapper comprises a first layer comprising a paper based material, and an extraction region in the wrapper; wherein the label is configured is configured to cover the extraction region and comprises a peripheral portion that extends beyond the extraction region such that the extraction region of the wrapper is sealed; and wherein the label is peelable away from the wrapper in use to open the extraction region to provide access to the inside of the wrapper.

In some embodiments, the label comprises a tab which is configured to gripped by a consumer to open the container.

In some embodiments, the label may be configured to cover a peripheral region around the extraction region when in the closed position such that the extraction region is sealed closed and configured to be impermeable.

In some embodiments, the paper based material may be a coated paper. In some embodiments, the coated paper may comprise a paper layer with a barrier coating. In some embodiments, the barrier coating may be a metallised layer. In some embodiments, the barrier coating may be a plastic film coating or a varnish layer.

In some embodiments, the paper based material may be a barrier paper. In some embodiments, the barrier paper may comprise a paper layer impregnated with a barrier material. In some embodiments, the barrier material may be a plastic, varnish, or metal.

In some embodiments, the wrapper may further comprise a second layer. In some embodiments, the second layer may comprise a metallised layer.

In some embodiments, the wrapper may further comprises a third layer. In some embodiments, the third layer may comprise a plastic film coating or a varnish layer.

In some embodiments, the inner frame may extend substantially the length of the wrapper.

In some embodiments, each component of the package may be formed from a material comprising the first layer of a paper based material. Each component of the package may be formed from a recyclable paper based material.

In some embodiments, the wrapper may have a weight of more than 70 grams per square meter. In some embodiments, the paper based material of the wrapper may have a weight of more than 70 grams per square meter.

In some embodiments, the outer flaps of the overlapping edges of the wrapper may have a rectangular shape.

In some embodiments, the outer flap of the overlapping edge may extend across a whole face of the package.

In some embodiments, the wrapper may further comprises a first clay layer on the inner surface of the first paper layer, and optionally, a second clay layer on the outer surface of the first paper layer.

In some embodiments, one of the second layer and the third layer may be applied on the inner surface of the first clay layer. In some embodiments, the other of the second layer and the third layer may be applied on the inner surface of the second or third layer on the inner surface of the first clay layer.

In some embodiments, the wrapper may be sealed at its overlapping edges. In some embodiments, the wrapper may be sealed by adhered together overlapping edges of the wrapper when the wrapper is folded to form the container.

In some embodiments, the wrapper may comprise a continuous section of adhesive extending along each of the overlapping edges of the wrapper when the wrapper is folded to form the container. In some embodiments, the wrapper may comprises a continuous section of adhesive extending around the whole perimeter of the inner surface of the wrapper. In some embodiments, the sealed overlapping edges of the wrapper may form a hermetic seal, such that the container is hermetically sealed before its first opening.

In some embodiments, the container may comprise a tamper evident means.

In some embodiments, the tamper evident means may be located on the wrapper. In some embodiments, the tamper evident means may comprises a stamp, wherein the stamp may be partially located on the label and may extend across the peripheral portion on to the wrapper.

In some embodiments, the stamp may comprise a line of weakening. In some embodiments, the stamp may comprise a tear strip formed from a plurality of lines of weakening and, optionally, a pull tab.

In some embodiments, the wrapper may comprise at least 90% of a first material and has a water vapor permeability of less than 6 g/m2/24 hr. In some embodiments, the wrapper may comprise at least 92.5% of the first material. In some embodiments, the wrapper may comprise at least 95% of the first material. In some embodiments, the wrapper may comprise at least 98.5% of the first material. In some embodiments, the wrapper may comprise the percentage of the first material by mass.

In some embodiments, the first material may be recyclable. In some embodiments, the first material may be compostable. In some embodiments, the first material may be a non-plastic material. In some embodiments, the first material is paper.

In some embodiments, the wrapper may further comprise a second material.

In some embodiments, the package may consist essentially of the container comprising a wrapper and a resealable label, and an inner frame located inside the container, wherein the wrapper comprises an extraction region in the wrapper, the wrapper comprising a paper based material.

BRIEF DESCRIPTION OF THE DRAWINGS

Embodiments of the invention will now be described, by way of example only, with reference to the accompanying drawings, in which.

DETAILED DESCRIPTION

Figure 1:
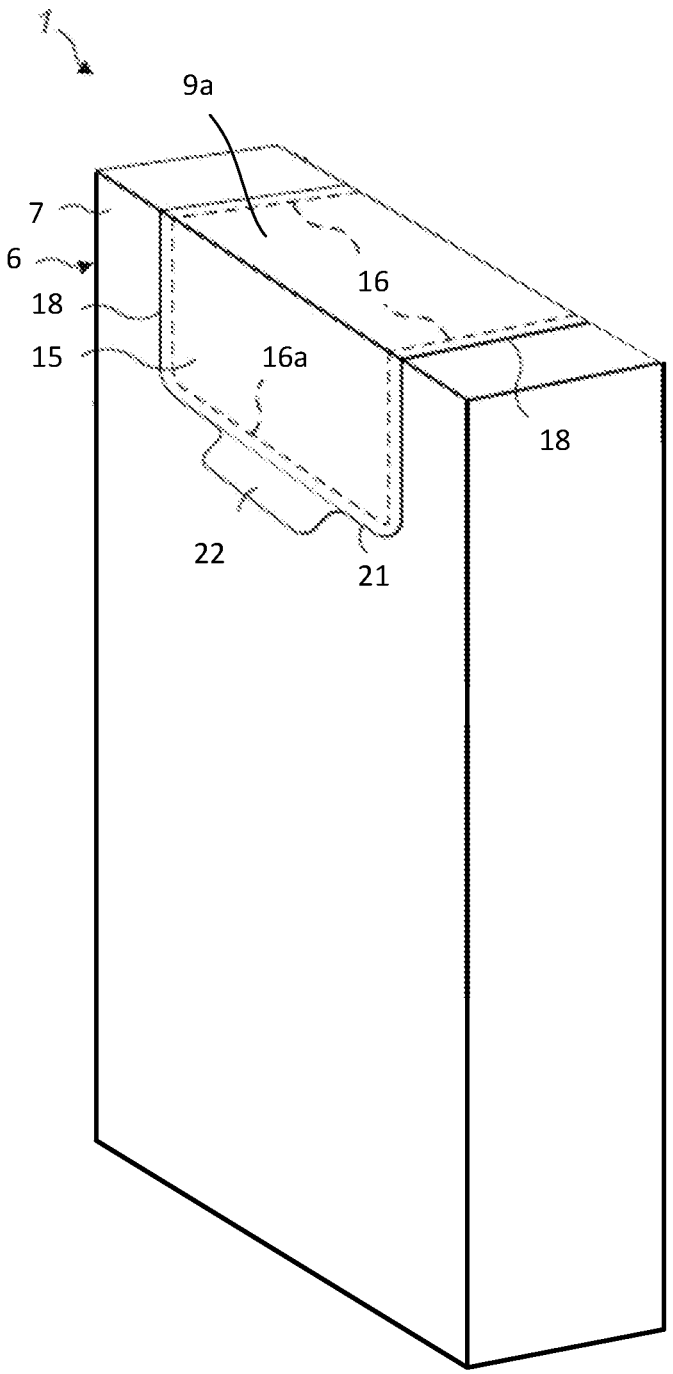
FIG. 1 shows a perspective view of a package according to the invention.

As used herein, the term "delivery system" is intended to encompass systems that deliver at least one substance to a user, and includes:

- combustible aerosol provision systems, such as cigarettes, cigarillos, cigars, and tobacco for pipes for roll your own or for make your own cigarettes (whether based on tobacco, tobacco derivatives, expanded tobacco, reconstituted tobacco, tobacco substitutes or other smokeable material);
- non-combustible aerosol provision systems that release compounds from an aerosol-generating material without combusting the aerosol-generating material, such as electronic cigarettes, tobacco heating products, and hybrid systems to generate aerosol using a combination of aerosol-generating materials; and
- aerosol-free delivery systems that deliver the at least one substance to a user orally, nasally, transdermally or in another way without forming an aerosol, including but not limited to, lozenges, gums, patches, articles comprising inhalable powders, and oral products such as oral tobacco which includes snus or moist snuff, wherein the at least one substance may or may not comprise nicotine.

According to the present disclosure, a "combustible" aerosol provision system is one where a constituent aerosol-generating material of the aerosol provision system (or component thereof) is combusted or burned during use in order to facilitate delivery of at least one substance to a user.

In some embodiments, the delivery system is a combustible aerosol provision system, such as a system selected from the group consisting of a cigarette, a cigarillo and a cigar.

In some embodiments, the disclosure relates to a component for use in a combustible aerosol provision system, such as a filter, a filter rod, a filter segment, a tobacco rod, a spill, an aerosol-modifying agent release component such as a capsule, a thread, or a bead, or a paper such as a plug wrap, a tipping paper or a cigarette paper.

According to the present disclosure, a "non-combustible" aerosol provision system is one where a constituent aerosol-generating material of the aerosol provision system (or component thereof) is not combusted or burned in order to facilitate delivery of at least one substance to a user.

In some embodiments, the delivery system is a non-combustible aerosol provision system, such as a powered non-combustible aerosol provision system.

In some embodiments, the non-combustible aerosol provision system is an electronic cigarette, also known as a vaping device or electronic nicotine delivery system (END), although it is noted that the presence of nicotine in the aerosol-generating material is not a requirement.

In some embodiments, the non-combustible aerosol provision system is an aerosol-generating material heating system, also known as a heat-not-burn system. An example of such a system is a tobacco heating system.

In some embodiments, the non-combustible aerosol provision system is a hybrid system to generate aerosol using a combination of aerosol-generating materials, one or a plurality of which may be heated. Each of the aerosol-generating materials may be, for example, in the form of a solid, liquid or gel and may or may not contain nicotine. In some embodiments, the hybrid system comprises a liquid or gel aerosol-generating material and a solid aerosol-generating material. The solid aerosol-generating material may comprise, for example, tobacco or a non-tobacco product.

Typically, the non-combustible aerosol provision system may comprise a non-combustible aerosol provision device and a consumable for use with the non-combustible aerosol provision device.

In some embodiments, the disclosure relates to consumables comprising aerosol-generating material and configured to be used with non-combustible aerosol provision devices. These consumables are sometimes referred to as articles throughout the disclosure.

In some embodiments, the non-combustible aerosol provision system, such as a non-combustible aerosol provision device thereof, may comprise a power source and a controller. The power source may, for example, be an electric power source or an exothermic power source. In some embodiments, the exothermic power source comprises a carbon substrate which may be energised so as to distribute power in the form of heat to an aerosol-generating material or to a heat transfer material in proximity to the exothermic power source.

In some embodiments, the non-combustible aerosol provision system may comprise an area for receiving the consumable, an aerosol generator, an aerosol generation area, a housing, a mouthpiece, a filter and/or an aerosol-modifying agent.

In some embodiments, the consumable for use with the non-combustible aerosol provision device may comprise aerosol-generating material, an aerosol-generating material storage area, an aerosol-generating material transfer component, an aerosol generator, an aerosol generation area, a housing, a wrapper, a filter, a mouthpiece, and/or an aerosol-modifying agent.

In some embodiments, the delivery system is an aerosol-free delivery system that delivers at least one substance to a user orally, nasally, transdermally or in another way without forming an aerosol, including but not limited to, lozenges, gums, patches, articles comprising inhalable powders, and oral products such as oral tobacco which includes snus or moist snuff, wherein the at least one substance may or may not comprise nicotine.

In some embodiments, the substance to be delivered may be an aerosol-generating material or a material that is not intended to be aerosolized. As appropriate, either material may comprise one or more active constituents, one or more flavors, one or more aerosol-former materials, and/or one or more other functional materials.

In some embodiments, the substance to be delivered comprises an active substance.

The active substance as used herein may be a physiologically active material, which is a material intended to achieve or enhance a physiological response. The active substance may for example be selected from nutraceuticals, nootropics, psychoactives. The active substance may be naturally occurring or synthetically obtained. The active substance may comprise for example nicotine, caffeine, taurine, theine, vitamins such as B6 or B12 or C, melatonin, cannabinoids, or constituents, derivatives, or combinations thereof. The active substance may comprise one or more constituents, derivatives or extracts of tobacco, cannabis or another botanical.

In some embodiments, the active substance comprises nicotine. In some embodiments, the active substance comprises caffeine, melatonin or vitamin B12.

As noted herein, the active substance may comprise one or more constituents, derivatives or extracts of cannabis, such as one or more cannabinoids or terpenes.

As noted herein, the active substance may comprise or be derived from one or more botanicals or constituents, derivatives or extracts thereof. As used herein, the term "botanical" includes any material derived from plants including, but not limited to, extracts, leaves, bark, fibers, stems, roots, seeds, flowers, fruits, pollen, husk, shells or the like. Alternatively, the material may comprise an active compound naturally existing in a botanical, obtained synthetically. The material may be in the form of liquid, gas, solid, powder, dust, crushed particles, granules, pellets, shreds, strips, sheets, or the like. Example botanicals are tobacco, eucalyptus, star anise, hemp, cocoa, cannabis, fennel, lemongrass, peppermint, spearmint, rooibos, chamomile, flax, ginger, *Ginkgo biloba*, hazel, hibiscus, laurel, licorice (liquorice), matcha, mate, orange skin, papaya, rose, sage, tea such as green tea or black tea, thyme, clove, cinnamon, coffee, aniseed (anise), basil, bay leaves, cardamom, coriander, cumin, nutmeg, oregano, paprika, rosemary, saffron, lavender, lemon peel, mint, juniper, elderflower, vanilla, wintergreen, beefsteak plant, curcuma, turmeric, sandalwood, cilantro, bergamot, orange blossom, myrtle, cassis, valerian, pimento, mace, damien, marjoram, olive, lemon balm, lemon basil, chive, carvi, verbena, tarragon, geranium, mulberry, ginseng, theanine, theacrine, maca, ashwagandha, damiana, guarana, chlorophyll, baobab or any combination thereof. The mint may be chosen from the following mint varieties: Mentha Arventis, Mentha c.v., Mentha niliaca, Mentha piperita, Mentha piperita citrata c.v., Mentha piperita c.v, Mentha spicata crispa, Mentha cardifolia, Memtha longifolia, Mentha suaveolens variegata, Mentha pulegium, Mentha spicata c.v. and Mentha suaveolens In some embodiments, the active substance comprises or is derived from one or more botanicals or constituents, derivatives or extracts thereof and the botanical is tobacco.

In some embodiments, the active substance comprises or derived from one or more botanicals or constituents, derivatives or extracts thereof and the botanical is selected from eucalyptus, star anise, cocoa and hemp.

In some embodiments, the active substance comprises or derived from one or more botanicals or constituents, derivatives or extracts thereof and the botanical is selected from rooibos and fennel.

In some embodiments, the substance to be delivered comprises a flavor.

As used herein, the terms "flavor" and "flavorant" refer to materials which, where local regulations permit, may be used to create a desired taste, aroma or other somatosensorial sensation in a product for adult consumers. They may include naturally occurring flavor materials, botanicals, extracts of botanicals, synthetically obtained materials, or combinations thereof (e.g., tobacco, cannabis, licorice (liquorice), hydrangea, eugenol, Japanese white bark magnolia leaf, chamomile, fenugreek, clove, maple, matcha, menthol, Japanese mint, aniseed (anise), cinnamon, turmeric, Indian spices, Asian spices, herb, wintergreen, cherry, berry, red berry, cranberry, peach, apple, orange, mango, clementine, lemon, lime, tropical fruit, papaya, rhubarb, grape, durian, dragon fruit, cucumber, blueberry, mulberry, citrus fruits, Drambuie, bourbon, scotch, whiskey, gin, tequila, rum, spearmint, peppermint, lavender, aloe vera, cardamom, celery, cascarilla, nutmeg, sandalwood, bergamot, geranium, khat, naswar, betel, shisha, pine, honey essence, rose oil, vanilla, lemon oil, orange oil, orange blossom, cherry blossom, cassia, caraway, cognac, jasmine, ylang-ylang, sage, fennel, wasabi, piment, ginger, coriander, coffee, hemp, a mint oil from any species of the genus Mentha, eucalyptus, star anise, cocoa, lemongrass, rooibos, flax, *Ginkgo biloba*, hazel, hibiscus, laurel, mate, orange skin, rose, tea such as green tea or black tea, thyme, juniper, elderflower, basil, bay leaves, cumin, oregano, paprika, rosemary, saffron, lemon peel, mint, beefsteak plant, curcuma, cilantro, myrtle, cassis, valerian, pimento, mace, damien, marjoram, olive, lemon balm, lemon basil, chive, carvi, verbena, tarragon, limonene, thymol, camphene), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, liquid such as an oil, solid such as a powder, or gas.

In some embodiments, the flavor comprises menthol, spearmint and/or peppermint. In some embodiments, the flavor comprises flavor components of cucumber, blueberry, citrus fruits and/or redberry. In some embodiments, the flavor comprises eugenol. In some embodiments, the flavor comprises flavor components extracted from tobacco. In some embodiments, the flavor comprises flavor components extracted from cannabis.

In some embodiments, the flavor may comprise a sensate, which is intended to achieve a somatosensorial sensation which are usually chemically induced and perceived by the stimulation of the fifth cranial nerve (trigeminal nerve), in addition to or in place of aroma or taste nerves, and these may include agents providing heating, cooling, tingling, numbing effect. A suitable heat effect agent may be, but is not limited to, vanillyl ethyl ether and a suitable cooling agent may be, but not limited to eucolyptol, WS-3.

Aerosol-generating material is a material that is capable of generating aerosol, for example when heated, irradiated or energized in any other way. Aerosol-generating material may, for example, be in the form of a solid, liquid or semi-solid (such as a gel) which may or may not contain an active substance and/or flavorants.

The aerosol-generating material may comprise a binder and an aerosol former. Optionally, an active and/or filler may also be present. Optionally, a solvent, such as water, is also present and one or more other components of the aerosol-generating material may or may not be soluble in the solvent. In some embodiments, the aerosol-generating material is substantially free from botanical material. In particular, in some embodiments, the aerosol-generating material is substantially tobacco free.

The aerosol-generating material may comprise or be an "amorphous solid". The amorphous solid may be a "monolithic solid". In some embodiments, the amorphous solid may be a dried gel. The amorphous solid is a solid material that may retain some fluid, such as liquid, within it. In some embodiments, the aerosol-generating material may, for example, comprise from about 50 wt %, 60 wt % or 70 wt % of amorphous solid, to about 90 wt %, 95 wt % or 100 wt % of amorphous solid.

The aerosol-generating material may comprise or be an aerosol-generating film. The aerosol-generating film may be formed by combining a binder, such as a gelling agent, with a solvent, such as water, an aerosol-former and one or more other components, such as active substances, to form a slurry and then heating the slurry to volatilize at least some of the solvent to form the aerosol-generating film. The slurry may be heated to remove at least about 60 wt %, 70 wt %, 80 wt %, 85 wt % or 90 wt % of the solvent. The aerosol-generating film may be a continuous film or a discontinuous film, such an arrangement of discrete portions of film on a support. The aerosol-generating film may be substantially tobacco free.

The aerosol-generating film may comprise or be a sheet, which may optionally be shredded to form a shredded sheet.

The aerosol-generating material may comprise one or more active substances and/or flavors, one or more aerosol-former materials, and optionally one or more other functional material.

The aerosol-former material may comprise one or more constituents capable of forming an aerosol. In some embodiments, the aerosol-former material may comprise one or more of glycerol, propylene glycol, diethylene glycol, triethylene glycol, tetraethylene glycol, 1,3-butylene glycol, erythritol, meso-Erythritol, ethyl vanillate, ethyl laurate, a diethyl suberate, triethyl citrate, triacetin, a diacetin mixture, benzyl benzoate, benzyl phenyl acetate, tributyrin, lauryl acetate, lauric acid, myristic acid, and propylene carbonate.

The one or more other functional materials may comprise one or more of apH regulators, coloring agents, preservatives, binders, fillers, stabilizers, and/or antioxidants.

The material may be present on or in a support, to form a substrate. The support may, for example, be or comprise paper, card, paperboard, cardboard, reconstituted material, a plastics material, a ceramic material, a composite material, glass, a metal, or a metal alloy. In some embodiments, the support comprises a susceptor. In some embodiments, the susceptor is embedded within the material. In some alternative embodiments, the susceptor is on one or either side of the material.

A consumable is an article comprising or consisting of aerosol-generating material, part or all of which is intended to be consumed during use by a user. A consumable may comprise one or more other components, such as an aerosol-generating material storage area, an aerosol-generating material transfer component, an aerosol generation area, a housing, a wrapper, a mouthpiece, a filter and/or an aerosol-modifying agent. A consumable may also comprise an aerosol generator, such as a heater, that emits heat to cause the aerosol-generating material to generate aerosol in use. The heater may, for example, comprise combustible material, a material heatable by electrical conduction, or a susceptor.

A susceptor is a material that is heatable by penetration with a varying magnetic field, such as an alternating magnetic field. The susceptor may be an electrically-conductive material, so that penetration thereof with a varying magnetic field causes induction heating of the heating material. The heating material may be magnetic material, so that penetration thereof with a varying magnetic field causes magnetic hysteresis heating of the heating material. The susceptor may be both electrically-conductive and magnetic, so that the susceptor is heatable by both heating mechanisms. The device that is configured to generate the varying magnetic field is referred to as a magnetic field generator, herein.

An aerosol-modifying agent is a substance, typically located downstream of the aerosol generation area, that is configured to modify the aerosol generated, for example by changing the taste, flavor, acidity or another characteristic of the aerosol. The aerosol-modifying agent may be provided in an aerosol-modifying agent release component, that is operable to selectively release the aerosol-modifying agent The aerosol-modifying agent may, for example, be an additive or a sorbent. The aerosol-modifying agent may, for example, comprise one or more of a flavorant, a colorant, water, and a carbon adsorbent. The aerosol-modifying agent may, for example, be a solid, a liquid, or a gel.

The aerosol-modifying agent may be in powder, thread or granule form. The aerosol-modifying agent may be free from filtration material.

An aerosol generator is an apparatus configured to cause aerosol to be generated from the aerosol-generating material. In some embodiments, the aerosol generator is a heater configured to subject the aerosol-generating material to heat energy, so as to release one or more volatiles from the aerosol-generating material to form an aerosol. In some embodiments, the aerosol generator is configured to cause an aerosol to be generated from the aerosol-generating material without heating. For example, the aerosol generator may be configured to subject the aerosol-generating material to one or more of vibration, increased pressure, or electrostatic energy.

FIG. 1 shows a perspective view of a package 1 for an aerosol delivery system. The package 1 is free from a standard outer rigid pack.

The package 1 further comprises a container 6. The container 6 is generally the same as an inner container of a standard pack, which is normally located in an outer container. The container 6 comprises a wrapper 7 that is configured to surround at least one aerosol delivery system 8, shown in FIG. 5. An outer surface of the wrapper forms an outer surface of the package 1. The wrapper 7 may be formed from a flexible material. The term flexible material is used to describe a material that is more flexible or less rigid than the material that a standard rigid outer container for aerosol delivery systems is formed from. The wrapper 7 forms a wrapped bundle of aerosol delivery systems 8. The wrapper 7 comprises may comprise a barrier material 9. The wrapper 7 is sealed by the closure of its openings. The openings may refer to an extraction region or aperture in the wrapper 7, as will be described in more detail hereinafter, or openings formed in the process of wrapping the wrapper 7 around the delivery systems and the subsequent flaps formed by folding the wrapper 7 to close the openings.

The wrapper 7 comprises a first layer 11. The first layer 11 comprises a paper based material. The first layer 11 may be a paper layer 11*a*. In some embodiments, the paper layer may be a coated paper or a barrier paper. That is, the first layer 11 may be a paper based material that comprises a barrier material 9. The barrier material 9 may be applied as a coating to the paper layer or may be provided interspersed within the paper layer as a single layer. The barrier material 9 may be plastic or metal and may be applied as a coating 11*b* to the paper layer 11*a* or within the paper material as a single layer 11.

Figure 2:
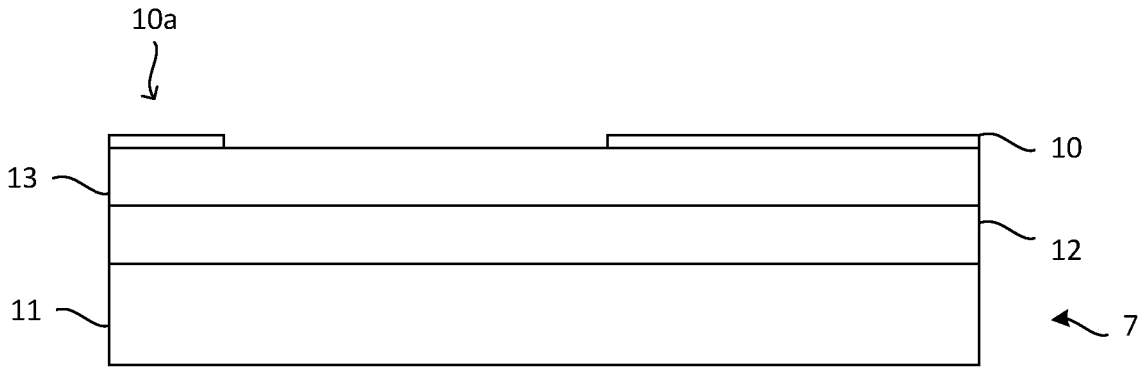
FIG. 2 shows a cross-sectional view of a wrapper of a container.

In some embodiments, the wrapper 7 may further comprise a second layer 12, as shown in FIG. 2. In some embodiments, the wrapper 7 may further comprise a third layer 13, as shown in FIG. 2.

In the present embodiment, the second layer 12 is a metallised layer 12. The metallised layer 12 is provided on the first layer 11, which is a paper based material 11. That is, a metal layer may be deposited, or otherwise applied, to the paper based material 11. In the present embodiment, the metallised layer 12 provides an initial barrier for the paper based material 11 to prevent, or at least reduce, the passage of moisture and/or aroma through the wrapper 7. That is, the metallised layer 12 is substantially impermeable. The metallised layer may have a weight of about 0.1 grams per meter. In some embodiments, the metallised layer may be aluminum.

Thu, in the present embodiment, the first and second layers combined effectively form a type of barrier coated paper. It will be understood that during manufacturing of the wrapper 7, a paper layer 11 may be provided and a second layer 12 applied to the paper layer 11 to form a coated paper or barrier paper. Alternatively, manufacturing of the wrapper 7 may begin with a coated paper or barrier paper, which removes the step of providing a paper layer 11 with a barrier material or coating.

In some embodiments, such as the one shown in FIG. 2, the third layer is a barrier coating 13, and is provided on the second layer 12; in this example, the metallised layer 12. The second layer 12 provides a smooth surface to enable the barrier coating 13 to be applied. A metallised layer 12 as the second layer provides a barrier to prevent the barrier coating 13 permeating into the first layer 11, which in this embodiment is a paper layer. Therefore, the barrier coating can be applied as a film without gaps, which increases the non-permeability of the wrapper 7.

Preferably, the barrier coating of the third layer 13 forms the inner surface of the wrapper 7. Therefore, the barrier coating 13 is facing internally and cannot be damaged by contact with a consumer or the environment.

As previously mentioned, the wrapper 7 is sealed by the closure of its openings, such as by the adhered sealing of its openings. In the present embodiment, the wrapper 7 is sealed at its overlapping edges 10*a*. The wrapper 7 may be sealed by adhering together the overlapping edges 10*a* of the wrapper 7 when it is folded to form the container 6. The adhesive 10 may be provided such that there is a continuous section of adhesive extending along each of the overlapping edges 10*a* of the wrapper 7 when the wrapper 7 is folded to form the container 6. The adhesive 10 may be provided on the wrapper 7 such that the adhesive 10 is not visible when the wrapper is folded to form the inner container 6.

The seals help to keep the contents fresh. This can also ensure that the wrapper 7 is sealed such that the free flow of water vapor and/or air into the container 6 is not permitted (aside from through the extraction region, once opened to access the at least one aerosol delivery system 8. This is in contrast with an arrangement in which a wrapper is formed to surround at least one aerosol delivery system, for example through the application of folds and limited adhesive, but which is not sealed by the closure of its openings, and as such presents openings or gaps through which the free flow of water vapor and/or air is permitted. In such an arrangement, the application of limited adhesive, such as spot adhesive, can be used to keep the folds in place, but does not necessarily preclude the free flow of water vapor and/or air through any openings or gaps presented by the geometry of the folds.

It is noted that the wrapper 7 may be sealed such that the free flow of water vapor and/or air into the container 6 is not permitted, while not necessarily being hermetically sealed. For instance, it may still be possible for water vapor and/or air or other gasses to diffuse through the material of the wrapper 7 and into the container 6; however, as the motion of the water vapor and/or air or other gasses is impeded by the material of the wrapper 7, this is not considered to be a free flow of water vapor and/or air or other gasses. That is, the adhesive seals along the overlapping edges 10*a* of the wrapper 7 are air tight such that the water vapor and/or air or other gasses cannot pass between overlapping portions of the wrapper 7, although water vapor and/or air or other gasses may still pass through the wrapper 7 to some degree.

In some embodiments, the wrapper 7 is sealed such that the inner container 6 is hermetically sealed. The hermetically sealed container 6 keeps the contents fresh for longer. The inner container 6 may be hermetically sealed by providing an adhesive 10, 20 on at least one of the outer surfaces of the wrapper 7. In the present embodiment, an adhesive 10 is provided on the outer surface of the wrapper 7, and an adhesive 10 is provided on the inner surface of the wrapper 7, as will be described in more detail hereinafter.

The adhesive 10 may be, for example, but not limited to, a glue, a lacquer, or a heat-seal adhesive. In some embodiments, the adhesive is configured to have a sealing temperature of in the range of over about 50° C., for example about 60° C. to about 65° C. This enables the activation temperature of the adhesive to be achieved in the short period of time, e.g. roughly 0.2 seconds, in which the wrapper 7 and adhesive 10 are between the sealing plates of the manufacturing apparatus (not shown). In addition, this sealing temperature is sufficiently above the operating temperature of the apparatus to prevent significant unwanted premature activation of the adhesive.

In some embodiments, the overlapping edges of the wrapper 7 may be sealed using an adhesive but the seal may not be hermetic. In some conditions, for example tropical conditions such as at 30° C. and 90% relative humidity (1249 ASTM), the wrapper 7 may have a water vapor permeability of less than 8 g/m2/24 hr. In some conditions, the wrapper 7 may have a water vapor permeability of less than 6 g/m2/24 hr at 30° C. and 90% relative humidity (1249 ASTM).

Figure 3:
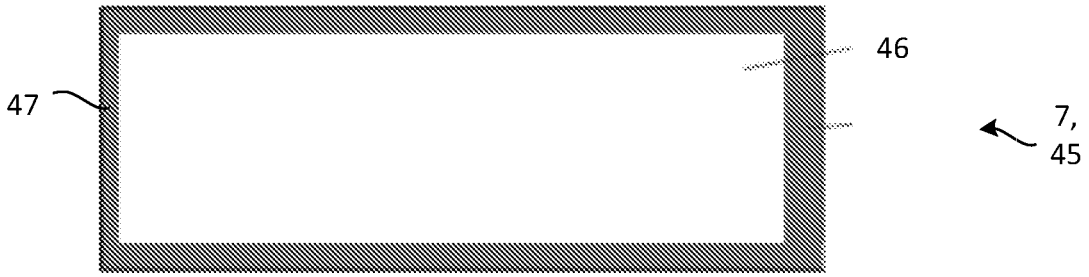
FIG. 3 shows an inner surface of blank of the wrapper.
Figure 4:
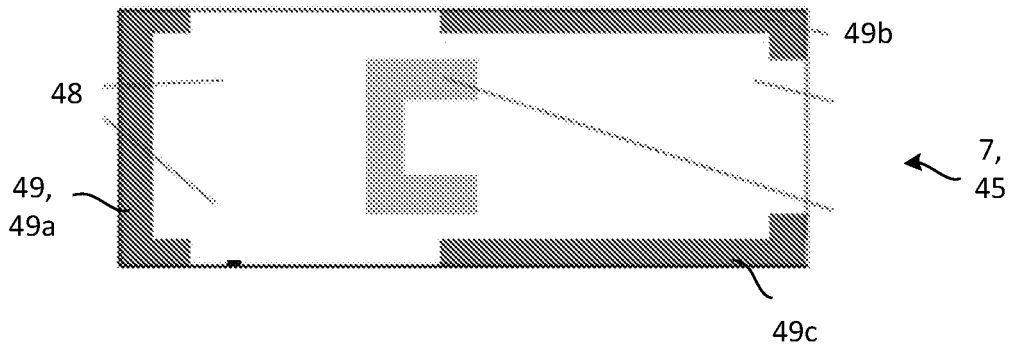
FIG. 4 shows an outer surface of blank of the wrapper.

For example, a blank 45 for forming a wrapper 7 is shown in FIGS. 3 and 4. The wrapper 7 may comprise an adhesive extending around the whole perimeter or edge 47 of the inner surface 46, as shown in FIG. 3, and, as shown in FIG. 4, the wrapper 7 may comprise an adhesive extending around at least one part of the perimeter or edge 49 of the outer surface 48 of the wrapper 7. In the embodiment shown, the blank 46 comprises an adhesive 10 on its front base flap forming edge 49*a* and on its rear side flap forming edges 49*b*, 49*c*.

Furthermore, when the blank 45 is folded and sealed to form the wrapper 7 outer flaps of the overlapping edges of the wrapper have a rectangular shape. Preferably, the outer flap of the overlapping edge extends across a whole face of the wrapper 7. Therefore, each of the side surfaces and optionally the bottom surface of the wrapper are formed by a single flap of the barrier material 9, respectively. As a result, each of the outer flaps provides a whole surface on which indicia and branding, etc. can be printed.

Figure 5:
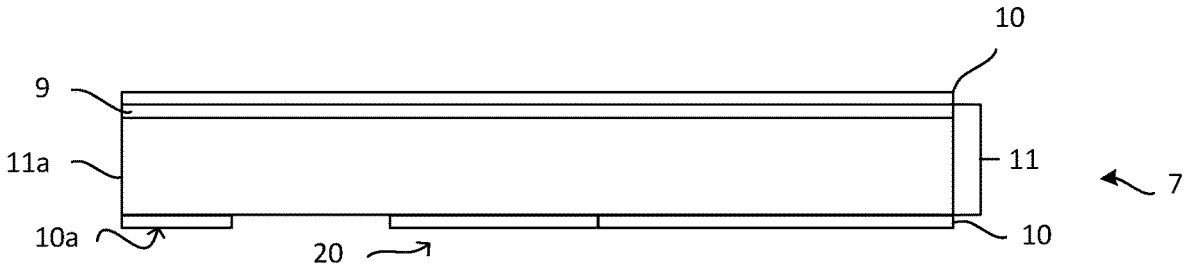
FIG. 5 5 shows a cross-sectional view of an embodiment of a wrapper.
Figure 6:
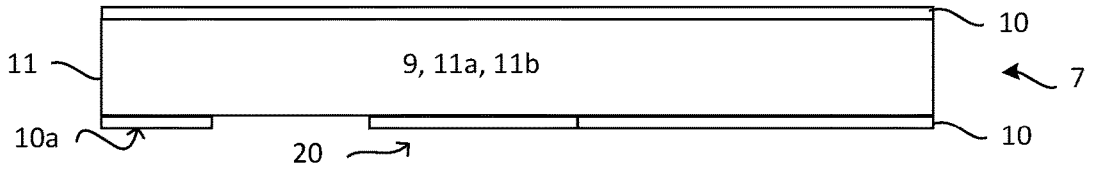
FIG. 6 shows a cross-sectional view of an embodiment of a wrapper.
Figure 7:
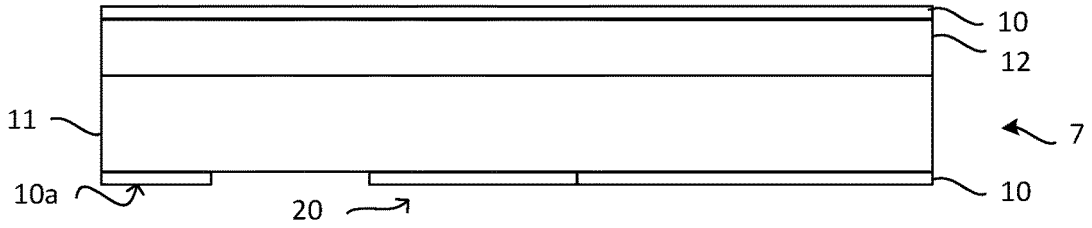
FIG. 7 shows a cross-sectional view of an embodiment of a wrapper.

Referring now to FIGS. 5, 6, 7. and 8, there is shown various different embodiments of the wrapper 7. For example, FIG. 5 shows an exemplary wrapper 7 comprising a first layer 11. The first layer 11 comprises a paper based material in the form of a barrier paper. That is, the first layer 11 comprises a paper layer 11*a* and a barrier material 9 in the form of a metal coating. In the present embodiment, the barrier material 9 is located on an inner surface of the paper layer 11*a*.

An alternative example illustrated in FIG. 6 shows a wrapper comprising a first layer 11 formed from a paper based material in the form of a barrier paper 11*b*, in which the barrier material 9 is within the paper layer 11*a* such that they form a single layer of material. The barrier material 9 may be, for example, but not limited to, metal or plastic.

Referring now to FIG. 7, a wrapper 7 comprising a first layer 11, formed by a paper layer 11*a*, and a second layer 12 is shown. In the present embodiment, the second layer 12 is located on an inner surface of the paper layer 11*a*.

Figure 8:
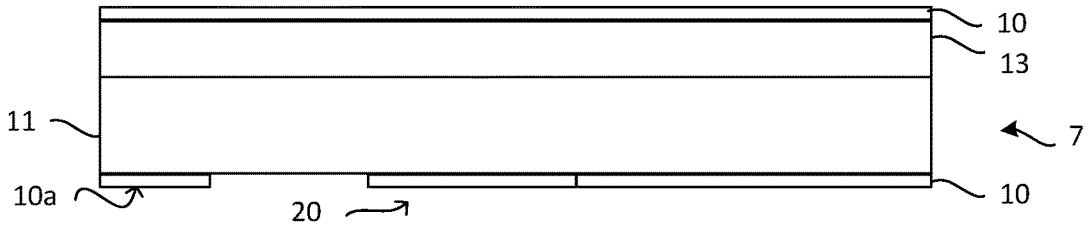
FIG. 8 shows a cross-sectional view of an embodiment of a wrapper.

Referring now to FIG. 8, a wrapper 7 comprising a first layer 11, formed by a paper layer 11*a*, and a third layer 13 on the paper layer 11*a* is shown. In the present embodiment, the third layer 13 is located on an inner surface of the paper layer 11*a*. There is no requirement for a second layer 12.

It will be understood, as explained above in relation to the second layer that in some embodiments the first and third layers 11, 13 combined may effectively form a type of barrier coated paper. It will be understood that during manufacturing of the wrapper 7, a paper layer 11 may be provided and a third layer 13 applied to the paper layer 11 to form a plastic or varnish coated paper or barrier paper. Alternatively, manufacturing of the wrapper 7 may begin with a plastic or varnish coated paper or barrier paper, which removes the step of providing a paper layer 11 with a plastic barrier material or coating.

Furthermore, it will be understood that in some embodiments, the second and/or third layer 12, 13 may be located on the outer surface of the first layer 11. Furthermore, it will be understood that in some embodiments, the second layer 12 may be on one side of the first layer 11 and the third layer may be on the other side of the first layer 11.

Referring back to FIG. 1, the wrapper 7 comprises an extraction region 15 formed from a removable region 7*a* of the wrapper 7. The bounds or edges 16 of the extraction region 15 formed from the removable region 7*a* of the wrapper 7 for allowing access to the aerosol delivery systems 8 is indicated by dotted lines. In the embodiment illustrated, the edges 16 of the extraction region 15 extend from the rearside of the wrapper 7 across the top of the container 6 and down the front as far as a lower front wall extraction region edge 16*a*.

The container 6 further comprises a resealable label 18. The resealable label 18 is configured to cover the extraction region 15. The resealable label 18 comprises a peripheral portion 19 that extends beyond the extraction region 15, such that the container 6 is sealed when the label 18 covers the extraction region 15. The resealable label 18 is peelable away from the wrapper 7 in use to open the extraction region 15 to provide access to the at least on aerosol delivery system 8 in the container 6.

The resealable label 18 lies over the extraction region 15 to seal the container 6 closed. The seal formed between the peripheral portion 19 of the label 18 and the portion of the wrapper 7 surrounding the extraction region 15 may be impermeable. The label 18 may also be formed from a sheet of the same material as the wrapper 7. The sheet of material that forms the label 18 has a re-stick adhesive on its undersurface nearer to the wrapper 7. Alternatively, a permanent bonding adhesive may be on the portion of the undersurface of the label 18 which does not overlie the edges of the sheet of material of the label 18, i.e. on the portion that overlies the removable region 7*a* of the wrapper 7. However, where the label 18 extends beyond the edges 16 of the extraction region 15, the undersurface is provided with re-stick adhesive.

In one embodiment, beyond one lower front wall edge 21 of the label 18 is a tab 22 which is at least partly free of re-stick adhesive so that it may be flicked up by the user and used to pull the label 18 to open the container 6. It will be understood that in some embodiments of the package, the package may not comprise a peelable label but instead have some other form of opening, i.e. adhered flaps.

On first use, the edge 16 of the extraction region 15 may be defined by lines of weakening in the wrapper 7. The lines of weakening in the wrapper 7 may be formed by at least one partial cut through the thickness of the wrapper 7. When the label 18 is pulled back, the section 7*a* of the wrapper 7 is separated from the remainder of the wrapper 7 to open the extraction region 15 and the consumer is then free to remove the aerosol delivery devices 8 from the container 6 through the extraction region 15 and, after having done so, reseal or close the extraction region 15 by bringing down the tab 22 so that the edge of the label 18 re-adheres to the adjacent portions of the wrapper 7 surrounding the extraction region 15. The region 7*a* of the wrapper 7 formed by the separation when the tab 22 is lifted is returned to its previous position. Although, there is a line of separation in the wrapper 7, it is covered by the adhered edges of the label 18.

Figure 9:
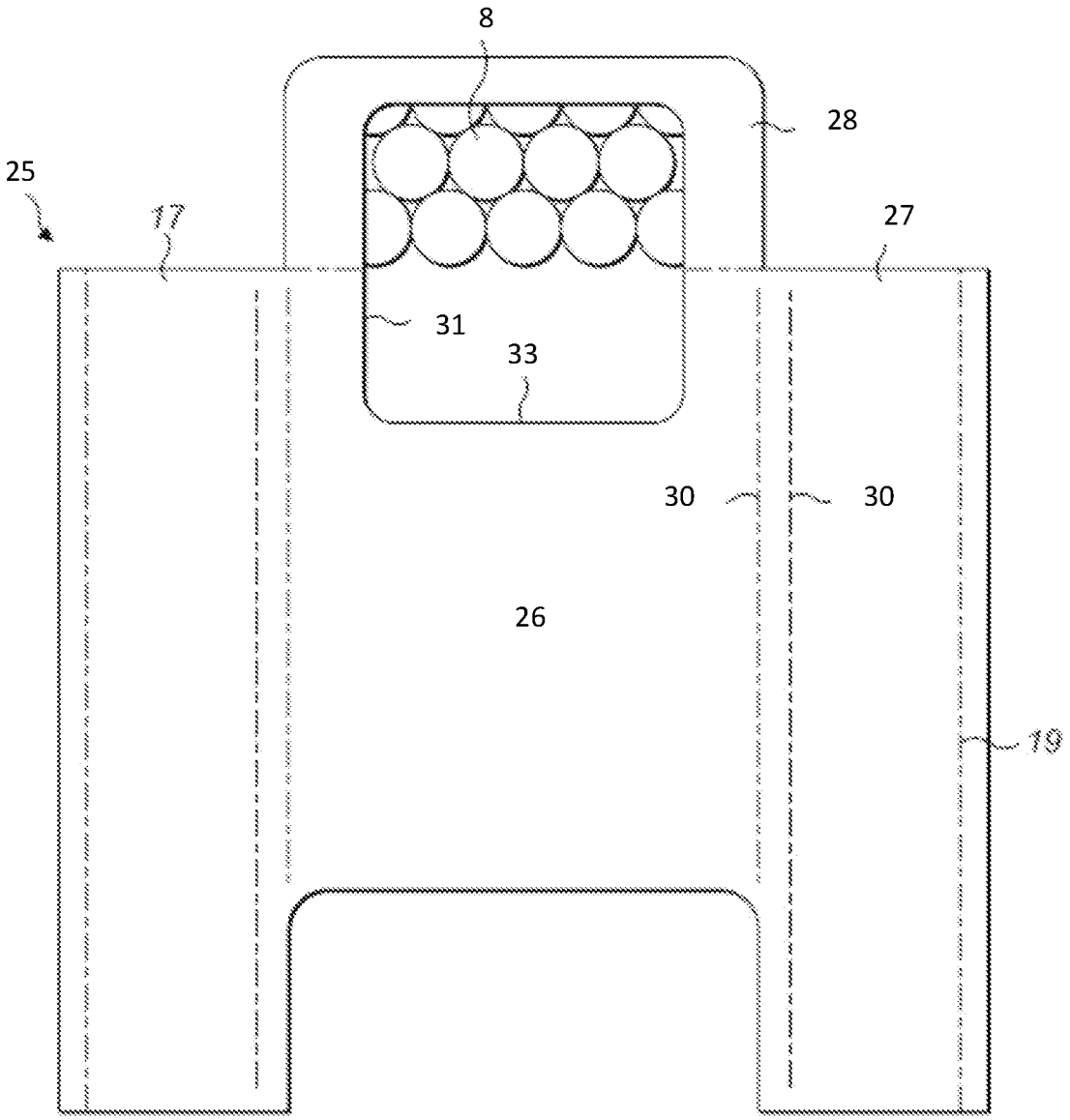
FIG. 9 shows an example of an inner frame in an unfolded condition.

Referring to FIG. 9, the package 1 may further comprise an inner frame 25. The inner frame 25 may be located inside the wrapper 7 of the container 6. To ensure efficient adhesion, the inner frame 25 may be provided within the container 6 so that it extends around the aerosol delivery systems 8 beneath the wrapper 7. The inner frame 25 is configured to support the wrapper 7. The inner frame 25 supports the wrapper 7 in order to prevent the container 6 becoming misshapen and to prevent the contents from becoming damaged.

The inner frame 25 provides a reaction surface underneath the wrapper 7 against the resealing pressure exerted by the label 18 around the periphery of the extraction region 15. By providing a reaction surface, the inner frame 25 opposes closing forces applied by the user, which prevents the articles from being damaged and protects their integrity. The reaction surface provided by the inner frame allows for the uses of the 'soft' wrapper as the outermost container, and also results in less material being used compared to a 'hard' outer pack, and so yields a lighter pack.

As shown in FIG. 9, the inner frame 25 has a front panel 26, two side flaps 27, and a top flap 28. Score or fold lines 30 form corners as seen in FIG. 9 when the side flaps 27 are folded to right angles with the panel 26. The top flap 28 is also folded to right angles. It can be seen that when the inner frame 25 has been folded there is an aperture 31 formed through which the aerosol delivery systems 8 will be accessible, as indicated in FIG. 5. The aperture 31 extends to a base edge 33 in the front panel 26.

At least the front panel 26 of the inner frame 25 may extend the length of the container 6 in order to provide the greatest reaction force possible. Each of the front panel 26, and side flaps 27 may extend the length of the container 6. In some embodiments, the inner frame 25 may further comprise a rear panel configured to extend the length of the container 6. In some embodiments, the inner frame 25 may further comprise a bottom panel. In these embodiments, at least some of the panels and flaps may be adhered to each other to provide a greater reaction force and help maintain the shape of the wrapper 7. It will be understood that in some embodiments of the package, the package may not comprise an inner frame.

Figure 10:
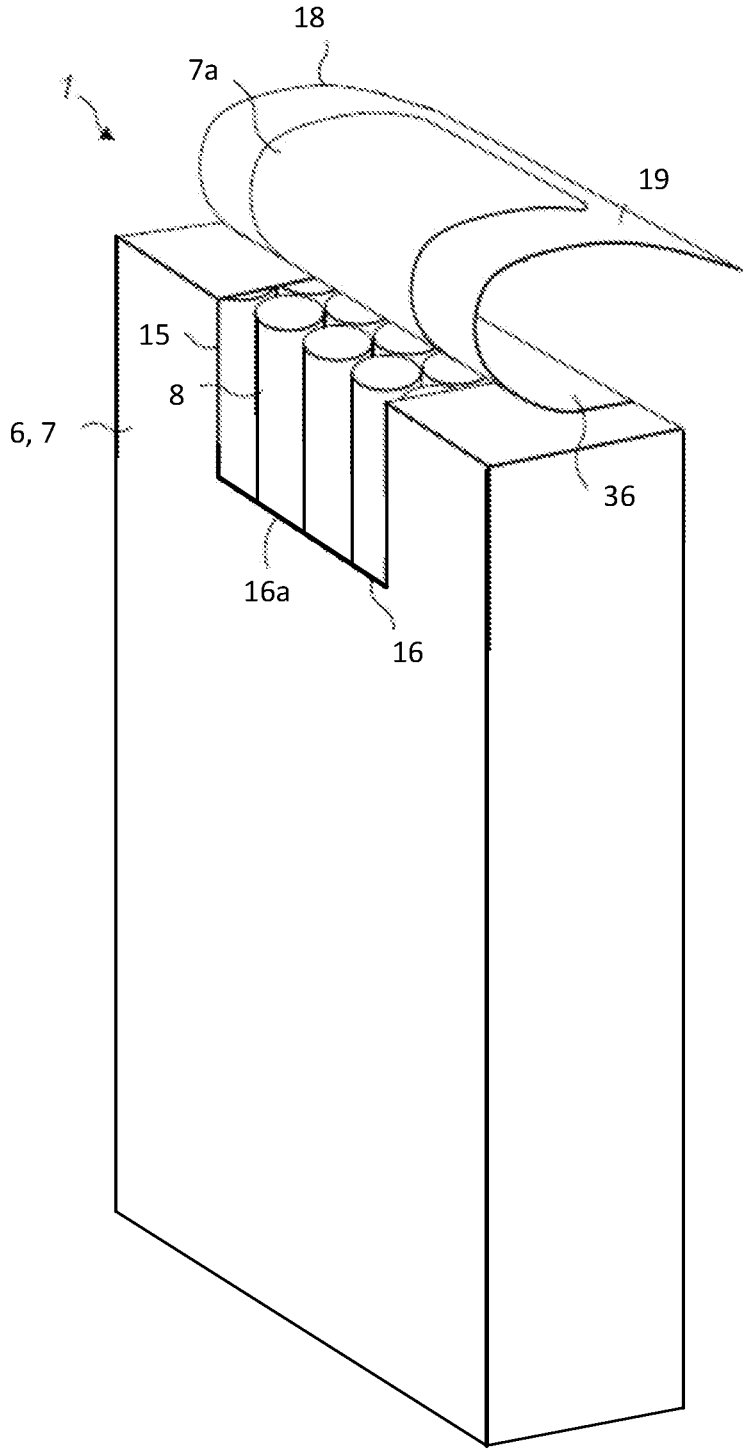
FIG. 10 shows a perspective view of the package, with the label peeled back in an open position.

A consumer may take hold of the tab 22 and lift the tab 22 so that the label 18 is peeled back to reveal the extraction region 15. In particular, with the label 18 in an open position, as shown in FIG. 10, the removable region 7*a* of the wrapper 7 is drawn back to reveal the extraction region 15 and enable a consumer to readily extract an aerosol delivery system 8 from the container 6.

Figure 11:
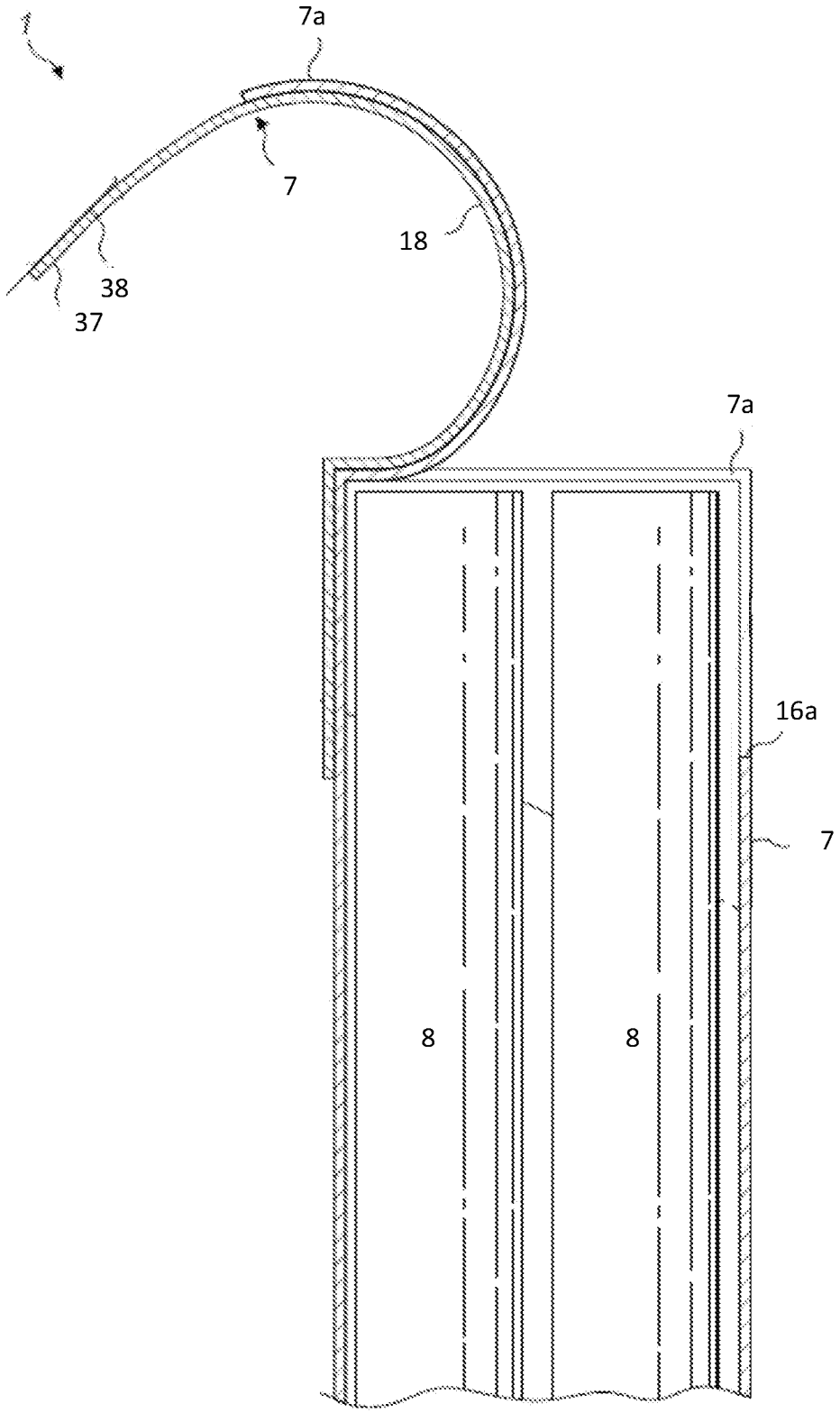
FIG. 11 shows a cross-sectional side view of the package, with the label in the open position.

To achieve opening of the label 18, the label 18 comprises a tab 22 at a lower edge of the label 18. The tab 22 may be foldable back on itself about a fold-line 38 separating the tab 22 from the remainder of the label 18 so that an inner surface 39, shown in FIG. 11, of the tab 22 that would normally lies against or faces an outer surface 36 of the wrapper 7 of the container 6 can be moved away from the wrapper 7 by a user to be held.

When the tab 22 is pivoted about the fold line 38, it can then be pulled upwards and/or away from the fold-line 38. The label 18 is also pulled due to the connection between the tab 22 and the label 18. This results in the label 18 being peeled back or rolled away from the extraction region 15 with the section 7*a* of the wrapper 7. If the package 1 is being opened for the first time, then the region 7*a* will also separate from the remainder of the wrapper 7 along the line of weakening that separates the region 7*a* from the remainder of the wrapper 7, as the container 6 is opened.

Figure 12:
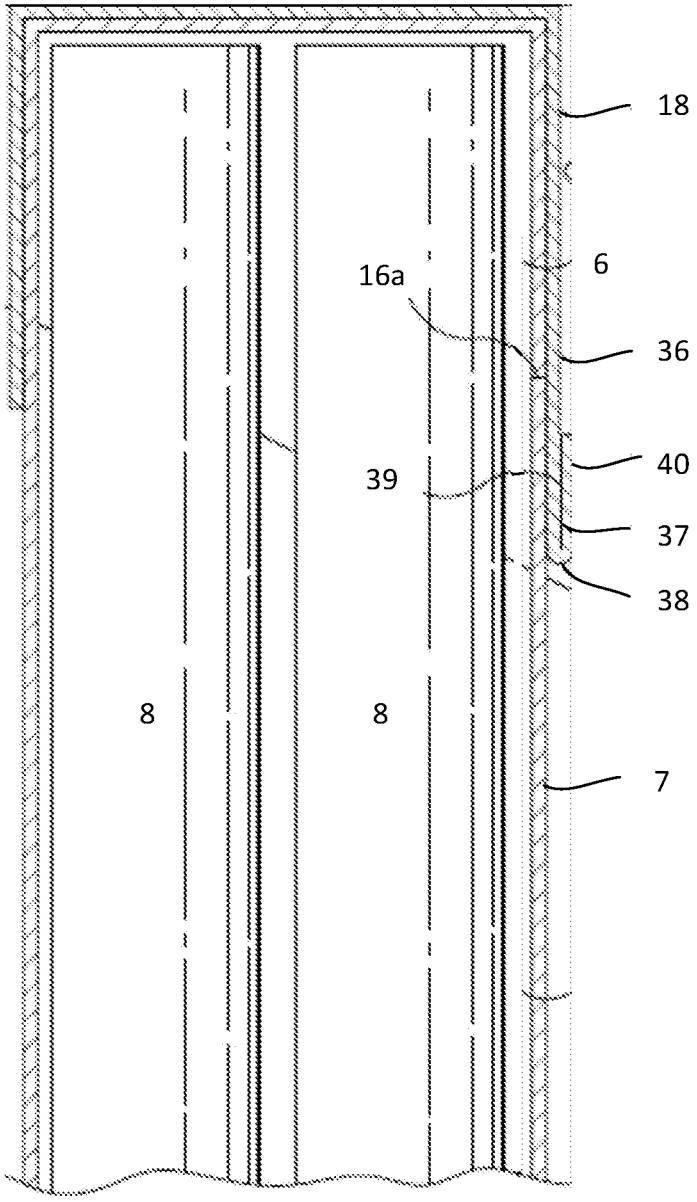
FIG. 12 shows a cross-section side view of the package, with the label in the closed position.

It will be appreciated that, when the container 6 is to be closed, as shown in FIG. 12, the label 18 will roll back across the extraction region 15 and the region 7*a* of the wrapper 7 will re-position itself within the extraction region 15. The peelable adhesive coating of the peripheral region of the label 18 will also re-adhere to the wrapper 7 surrounding the extraction region 15, thereby sealing closed the container 6 and closing the package 1.

Furthermore, each component of the package is formed by a paper based material. That is, the container 6 and inner frame 25 are both formed from a paper based material. In addition, it means that the package 1 does not comprise a plastic overwrap that is common in known packages. In fact, the construction of the wrapper 7 means that a plastic overwrap is not required in order to keep the contents of the package 1 fresh.

In some embodiments, the wrapper 7 has a weight of more than 70 grams per square meter (gsm). In some embodiments, the wrapper 7 has a weight of more than 100 gsm. In some embodiments, the paper based material 11 has a paper weight of more than 70 grams per square meter (gsm). In some embodiments, the paper based material 11 has a paper weight of more than 100 gsm.

In some embodiments, the wrapper 7 comprises at least 90% of a first material. The first material may be a paper based material. In some embodiments, the wrapper 7 may also have a water vapor permeability of less than 8 g/m2/24 hr or less than 6 g/m2/24 hr, as tested under ASTM F 1249 at 38° and 90% relative humidity.

The large percentage of a single material increases the likelihood of the material being easily recyclable. Furthermore, the low water vapor permeability prevents water vapor from passing through the wrapper 7 such that the container 6 can keep its contents fresh for longer.

In some embodiments, the wrapper 7 comprises at least 92.5% of the first material. In other embodiments, the wrapper 7 comprises at least 95% of the first material. In yet further embodiments, the wrapper 7 comprises at least 98.5% of the first material. In some embodiments, the percentage of the first material is calculated based on the mass of the first material and the wrapper 7.

Preferably, the water vapor permeability of the first material is less than 6 g/m2/24 hr at 30° C. and 90% relative humidity (1249 ASTM). More preferably, the water vapor permeability of the first material is less than 5 g/m2/24 hr, more preferably, less than 3 g/m2/24 hr, and even more preferably, less than 1 g/m2/24 hr at the same conditions as mentioned above. The lower the water vapor permeability of the first material, the longer the components and/or articles and/or delivery systems within the container 6 can be kept fresh.

Preferably, the wrapper 7 is recyclable. Preferably, the first material is compostable. Preferably, the first material is a non-plastic material. The first material maybe, for example, but not limited to, paper.

In some embodiments, the wrapper 7 may comprise a second material. The second material may be metallic. The first and second materials may be arranged in layers to form the wrapper 7 that forms the container 6. Preferably, the second material which forms the second layer is applied to the first material which forms the first layer as a coating. The metallic layer may protect the paper layer from breaking.

The wrapper 7 may comprises less than 10% of the second material by weight. In other embodiments, the wrapper 7 comprises less than 5% of the second material. In yet further embodiments, the wrapper 7 comprises less than 2.5% of the second material. In some embodiments, the percentage of the second material is calculated based on the mass of the second material and the wrapper 7.

In some embodiments, the wrapper 7 may comprise a third material. The third material may be plastic. The first, second, and third materials may be arranged in layers to form the wrapper 7 that forms the container 6, as described above. Preferably, the third material which forms the third layer is applied to the second material which forms the second layer as a coating. The third material may be a plastic coating The metallic second layer may be partially absorbed by the first paper layer such that it forms a good connection with the first layer and provides a smooth outer surface. The plastic coating layer can be applied to the second metallic layer. Due to the metallic layer being smooth, the plastic coating layer does not have any holes therein. This prevents air and water vapor from passing through the plastic third layer. The plastic coating may be impermeable.

The wrapper 7 may comprises less than 10% of the third material by weight. In other embodiments, the wrapper 7 comprises less than 5% of the third material. In yet further embodiments, the wrapper 7 comprises less than 2.5% of the third material. In some embodiments, the percentage of the third material is calculated based on the mass of the third material and the wrapper 7.

Figure 13:
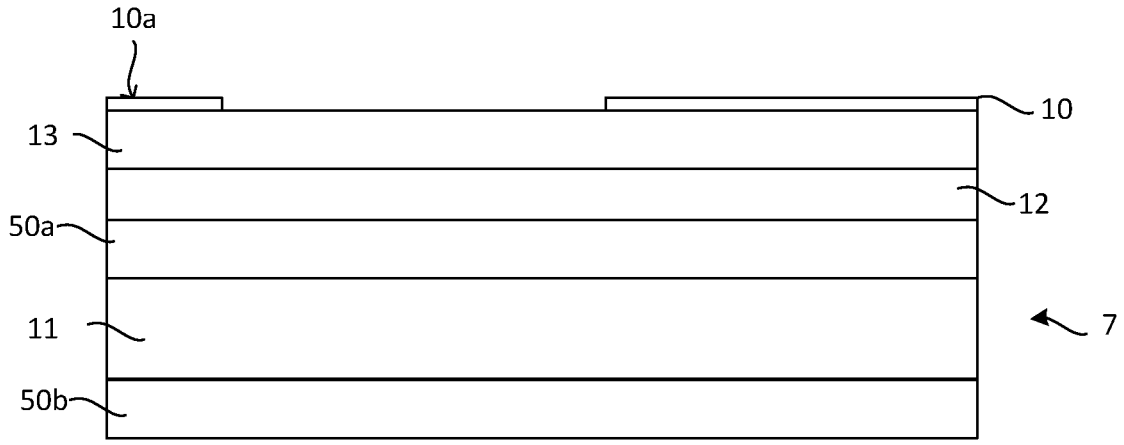
FIG. 13 shows a cross-sectional view of an embodiment of a wrapper.

In some embodiments, the wrapper 7 may further comprise a clay layer 50, as shown in FIG. 13. The wrapper 7 may comprise a first clay layer 50*a* on an inner surface of the first layer, which in the present embodiment is a paper based material 11 such as paper. The first clay layer 50*a* may be located between the first layer 11 and the second layer, which in this embodiment is a metallised layer 12. Alternatively, the first clay layer 50*a* may be located between the first layer 11 and a third layer 13, which may be a plastic or varnish coating. Therefore, the metallised layer 12 or barrier coating 13 are applied on the inner surface of the first clay layer 50*a*. The first clay layer 50*a* forms a layer to which a metallised layer is more readily attachable.

The wrapper 7 may further comprise a second clay layer 50*b* on an outer surface of the paper based material 11. The second clay layer 50*b* may form an outer surface of the wrapper 7 on which indicia can be printed.

Figure 14:
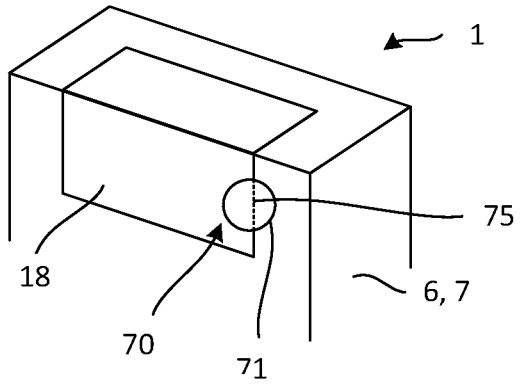
FIG. 14 shows an embodiment of a tamper evident means on a container.
Figure 15:
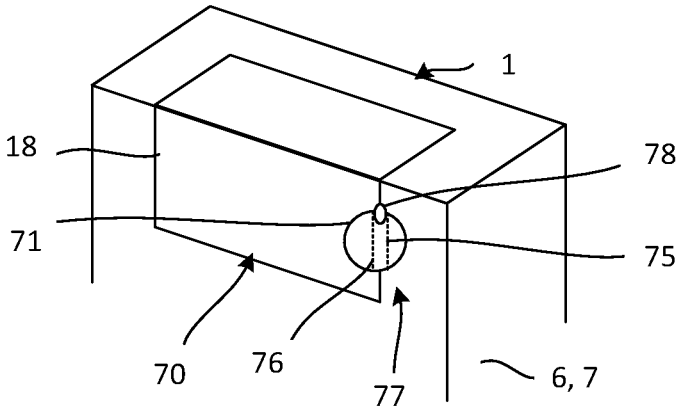
FIG. 15 shows another embodiment of a tamper evident means on the container.

The package 1 may further comprise a tamper evident means 70. More specifically, the container 6 may comprise the tamper evident means 70, as shown in FIGS. 14 and 15. The tamper evident means 70 may be attached to both the label 18 and the wrapper 7 such that the tamper evident means indicates whether the container 6 has been previously opened, or whether an attempt to open the container 6 has been made.

The tamper evident means provides a user with an indication of whether the package 1 has been opened previously, which is required in the present invention as the outer plastic wrap that normally provides an indication of tampering is removed so that the whole package 1 can be recyclable.

The tamper evident mean 70 may comprise a stamp or sticker 71. The stamp 71 may be located on the label 18 and extending across the peripheral portion onto the wrapper 7. That is, the stamp 71 has at least a portion adhered to the label 18 and at least a portion adhered to the wrapper 7.

The stamp 71 may comprise a line of weakening 75, as shown in FIG. 14. The line of weakening 75 may extend along the edge of the label 18. Thus, upon first opening of the container 6, the line of weakening 75 may be at least partially broken to indicate that an attempt has been made to open the container 6.

In another embodiment shown in FIG. 15, the stamp 71 may comprise a second line of weakening 76 that extends parallel to but spaced from the first line of weakening 75 to form a tear tape 77. The tear tape 77 may comprise a tab 78 on one end for a consumer to pull.

The various embodiments described herein are presented only to assist in understanding and teaching the claimed features. These embodiments are provided as a representative sample of embodiment only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilized and modifications may be made without departing from the scope of the claimed invention. Various embodiments of the invention may suitably comprise, consist of, or consist essentially of, appropriate combinations of the disclosed elements, components, features, parts, steps, means, etc. other than those specifically described herein. In addition, this disclosure may include other inventions nor presently claimed, but which may be claimed in the future.

The invention claimed is:

1. A package for at least one delivery system, the package comprising:

a container comprising a wrapper configured to surround the at least one delivery system, and a resealable label; wherein the wrapper is sealed by the closure of its openings and an outer surface of the wrapper forms an outer surface of the package, wherein the wrapper forms the outermost container and the package is free from an outer rigid pack; and an inner frame located inside the container;

wherein the wrapper comprises a first layer comprising a paper based material, and an extraction region in the wrapper;

wherein the label is configured to cover the extraction region and comprises a peripheral portion that extends beyond the extraction region such that the extraction region of the wrapper is sealed; and wherein the label is peelable away from the wrapper in use to open the extraction region to provide access to the inside of the wrapper.

2. The package according to claim 1, wherein the label comprises a tab which is configured to be gripped by a consumer to open the container.

3. The package according to claim 1, wherein the label is configured to cover a peripheral region around the extraction region when in the closed position such that the extraction region is sealed closed and configured to be impermeable.

4. The package according to claim 1, where in the paper based material is a coated paper, and wherein the coated paper comprises a paper layer with a barrier coating.

5. The package according to claim 4, wherein the barrier coating is a metallized layer, a plastic film coating or a varnish layer.

6. The package according to claim 1, wherein the paper based material is a barrier paper, and wherein the barrier paper comprises a paper layer impregnated with a barrier material.

7. The package according to claim 6, wherein the barrier material is a plastic, varnish, or metal.

8. The package according to claim 1, wherein the wrapper further comprises a second layer comprising a metallized layer.

9. The package according to claim 8, wherein the wrapper further comprises a third layer comprising a plastic film coating or a varnish layer.

10. The package according to claim 1, wherein at least one of the following:

the inner frame extends substantially the length of the wrapper, each component of the package is formed from a material comprising the first layer of a paper based material, the wrapper has a weight of more than 70 grams per square meter, and the paper based material of the wrapper has a weight of more than 70 grams per square meter.

11. The package according to claim 1, wherein at least one of the following:

outer flaps of the overlapping edges of the wrapper have a rectangular shape, and outer flaps of the overlapping edge extend across a whole face of the package.

12. The package according to claim 1, wherein at least one of the following:

the wrapper further comprises a first clay layer on the inner surface of the first layer, the wrapper further comprises a second clay layer on the outer surface of the first layer, the wrapper further comprises a first clay layer on the inner surface of the first layer and one of the second layer and the third layer is applied on the inner surface of the first layer, and the wrapper further comprises a first clay layer on the inner surface of the first layer and one of the second layer and the third layer is applied on the inner surface of the first layer and the other of the second layer and the third layer is applied on the inner surface of the second or third layer on the inner surface of the first clay layer.

13. The package according to claim 1, wherein at least one of the following:

the wrapper is sealed at its overlapping edges, the wrapper is sealed by adhered together overlapping edges of the wrapper when the wrapper is folded to form the container, the wrapper is sealed at its overlapping edges and comprises a continuous section of adhesive extending along each of the overlapping edges of the wrapper when the wrapper is folded to form the container, and the wrapper is sealed at its overlapping edges and comprises a continuous section of adhesive extending around the whole perimeter of the inner surface of the wrapper.

14. The package according to claim 13, wherein the sealed overlapping edges of the wrapper form a hermetic seal, such that the container is hermetically sealed before its first opening.

15. The package according to claim 1, wherein the container comprises a tamper evident means.

16. The package according to claim 15, wherein the tamper evident means is located on the wrapper.

17. The package according to claim 1, wherein the wrapper comprises at least 90% of a first material and has a water vapor permeability of less than 6 g/m2/24 hr.

18. The package according to claim 17, wherein the first material is paper.

19. The package according to claim 17, wherein the wrapper further comprises a second material.

20. The package according to claim 1, wherein the package consists essentially of the container comprising a wrapper and a resealable label, and an inner frame located inside the container, wherein the wrapper comprises an extraction region in the wrapper, the wrapper comprising a paper based material.

* * * * *